US008468729B1

(12) United States Patent
Sylvester

(10) Patent No.: US 8,468,729 B1
(45) Date of Patent: Jun. 25, 2013

(54) BUFFER TUBE

(75) Inventor: Dean Sylvester, Boisie, ID (US)

(73) Assignee: Primary Weapons, Boise, ID (US)

( * ) Notice: Subject to any disclaimer, the term of this patent is extended or adjusted under 35 U.S.C. 154(b) by 156 days.

(21) Appl. No.: 13/008,299

(22) Filed: Jan. 18, 2011

Related U.S. Application Data

(60) Provisional application No. 61/295,938, filed on Jan. 18, 2010.

(51) Int. Cl.
*F41A 21/00* (2006.01)

(52) U.S. Cl.
USPC ..... 42/1.06; 42/1.01; 42/71.01; 42/72; 42/73; 42/74

(58) Field of Classification Search
USPC ..... 42/71.01, 72, 73, 74
See application file for complete search history.

(56) References Cited

U.S. PATENT DOCUMENTS

| | | | | |
|---|---|---|---|---|
| 3,405,470 | A * | 10/1968 | Wesemann | 42/74 |
| 3,417,660 | A * | 12/1968 | Harbrecht | 89/198 |
| 3,461,589 | A * | 8/1969 | Vironda | 42/74 |
| 4,644,987 | A * | 2/1987 | Kiang | 42/96 |
| 5,909,002 | A * | 6/1999 | Atchisson | 89/130 |
| 6,758,126 | B1 * | 7/2004 | Houtsma | 89/198 |
| 7,131,367 | B1 * | 11/2006 | Boerschig et al. | 89/198 |
| 7,213,498 | B1 * | 5/2007 | Davies | 89/198 |
| 7,398,616 | B1 * | 7/2008 | Weir | 42/73 |
| 7,681,351 | B2 * | 3/2010 | Bucholtz et al. | 42/1.06 |
| 7,793,453 | B1 * | 9/2010 | Sewell et al. | 42/73 |
| 7,823,313 | B2 * | 11/2010 | Faifer | 42/74 |
| 8,037,806 | B2 * | 10/2011 | Davies | 89/198 |
| 2004/0031182 | A1 * | 2/2004 | Bentley | 42/74 |
| 2005/0115134 | A1 * | 6/2005 | Bond et al. | 42/74 |
| 2008/0110074 | A1 * | 5/2008 | Bucholtz et al. | 42/1.06 |
| 2010/0050492 | A1 * | 3/2010 | Faifer | 42/1.06 |
| 2010/0251587 | A1 * | 10/2010 | Kincel | 42/1.06 |
| 2010/0251588 | A1 * | 10/2010 | Kincel | 42/1.06 |

* cited by examiner

*Primary Examiner* — Samir Abdosh
(74) *Attorney, Agent, or Firm* — Dwayne E. Rogge; Schacht Law Office, Inc.

(57) ABSTRACT

Disclosed herein is an improved buffer tube assembly comprising a buffer tube having a longitudinal forward end, a longitudinal rearward end, and an inner annular surface. The buffer tube further comprises an attachment location operably configured to couple the buffer tube to a lower receiver of a firearm. One novel feature is a dead blow buffer positioned at the longitudinally rearward portion of the buffer tube. The buffer tube comprising an external surface configured to fit within and substantially in contact with the internal bore surface of the buffer tube, wherein the dead blow buffer is configured to receive an impact from a buffer that is attached to a buffer spring fitted within the buffer tube. In one form, the dead blow buffer is positioned between the rearmost portion of the inner annular surface of the buffer tube and the buffer spring.

12 Claims, 5 Drawing Sheets

BUFFER TUBE

RELATED APPLICATIONS

This application claims priority benefit of U.S. Ser. No. 61/295,938, filed Jan. 18, 2010.

BACKGROUND OF THE DISCLOSURE

Field of the Disclosure

Buffer tubes are utilized in firearms, such as, for example an AR 15, AR 10, SR 25, M-16 and variants thereof. Buffer tubes have various structural integrity requirements to handle difficult circumstances. Therefore, there is a need for a new improved buffer tube in one form configured to be attached to a lower receiver of a firearm.

SUMMARY OF THE DISCLOSURE

Disclosed herein is an improved buffer tube assembly comprising a buffer tube having a longitudinal forward end, a longitudinal rearward end, and an inner annular surface. The buffer tube further comprises an attachment location operably configured to couple the buffer tube to a lower receiver of a firearm. One novel feature is a malleable dead blow buffer positioned at the longitudinally rearward portion of the buffer tube. The dead blow buffer comprising an external surface configured to fit within and substantially in contact with the internal bore surface of the buffer tube, wherein the dead blow buffer is configured to receive an impact from a buffer that is attached to a buffer spring fitted within the buffer tube. In one form, the dead blow buffer is positioned between the rearmost portion of the inner annular surface of the buffer tube and the buffer spring.

DESCRIPTION OF THE PREFERRED EMBODIMENTS

Figure 1:
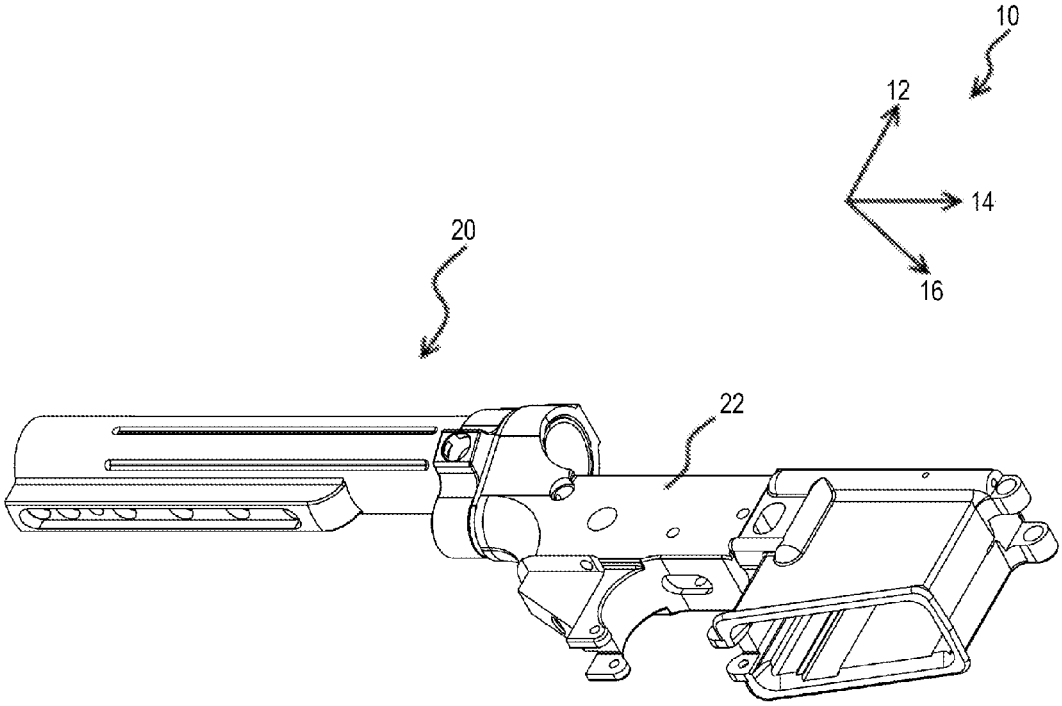
FIG. 1 shows an isometric view of a lower receiver attached to a buffer tube.

As shown in FIG. 1, there is a buffer tube assembly 20 attached to a lower receiver 22. Before any further description begins, an axes system 10 is defined where the axis 12 indicates a vertical direction, the axis 14 indicates a longitudinal direction, and the axis 16 indicates a lateral direction. The axis system is generally provided for reference and is not intended to limit the disclosure to particular strict orientations.

Figure 5:
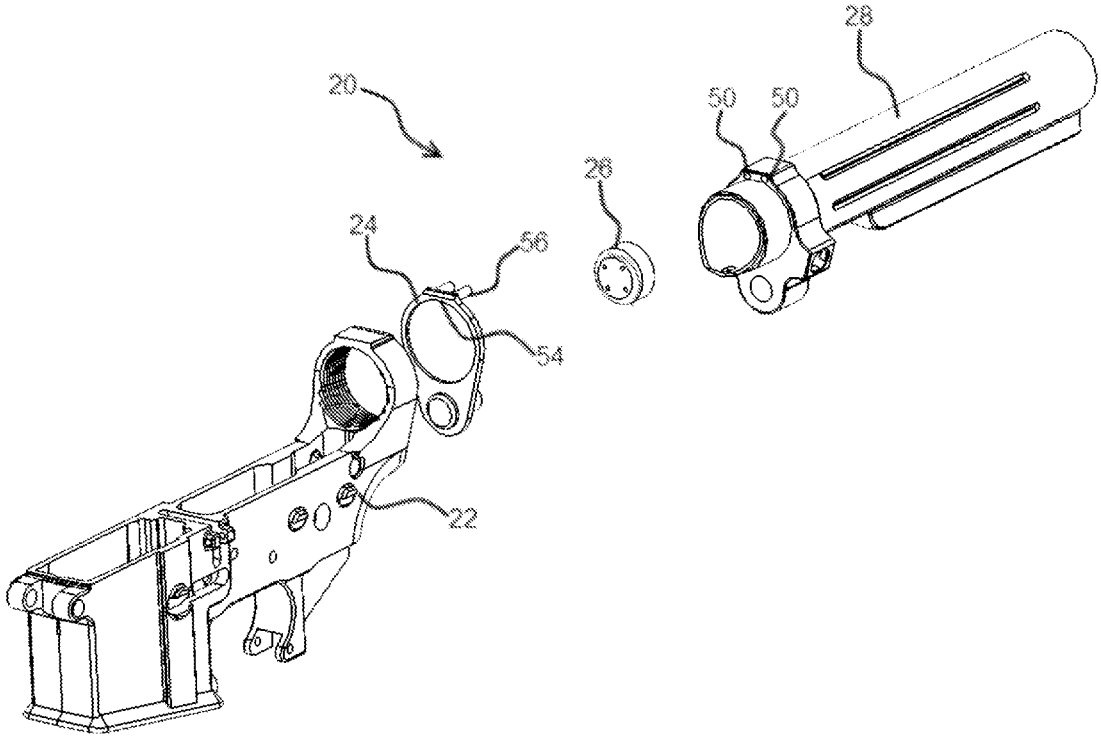
FIG. 5 shows an exploded view of the buffer tube and the lower receiver and other components utilized to attach the buffer tube to a lower receiver.

Referring ahead now to FIG. 5, there is shown the lower receiver 22, where the buffer tube assembly 20 is shown in an exploded view. In general, the buffer tube assembly 20 comprises an indexing plate 24, a dead blow buffer 26 and a buffer tube 28.

Figure 2:
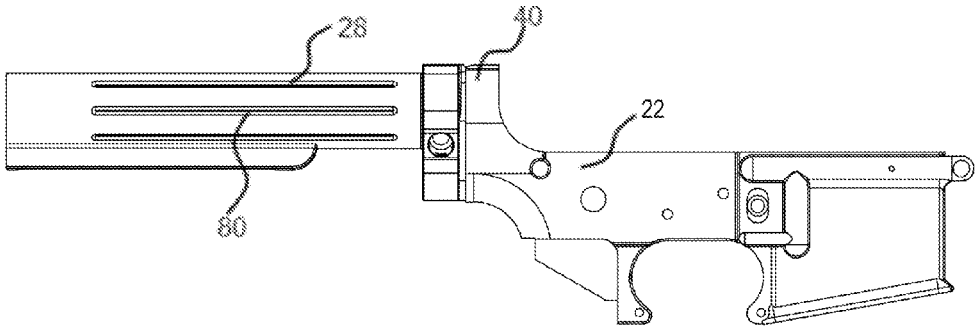
FIG. 2 shows a side view of a buffer tube attached to a lower receiver.
Figure 4:
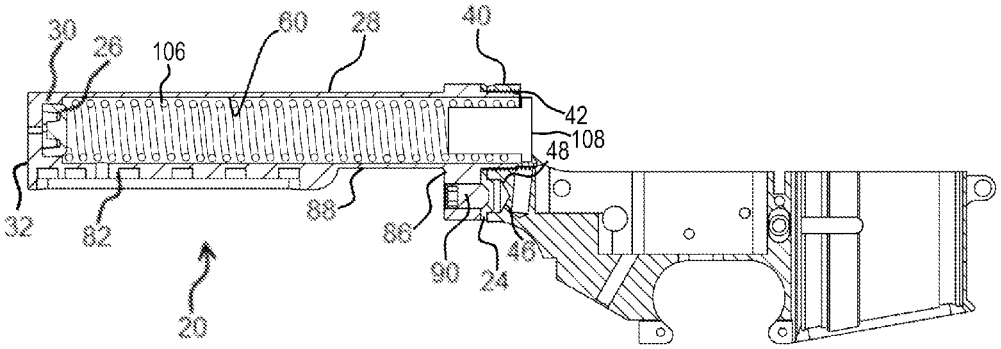
FIG. 4 shows a cross-sectional view taken at line 4-4 of FIG. 3.

As shown in FIG. 4, the dead blow buffer 26 is operatively configured to fit within the inner annular surface 30, which is positioned at the longitudinally rearward portion 32 of the buffer tube 28. As shown in FIG. 2, the buffer tube 28 is configured to attach to the lower receiver 22 at the attachment location 40. In general, as shown in FIG. 4, in one form the threaded extension 42 is engaging the female interior portion of the attachment location 40. As further shown in FIG. 4, the indexing plate 24 is interposed therebetween, whereby an extension 46 is configured to engage the recess 48 of the lower receiver. As shown in FIG. 5, the surfaces defining openings 50 are provided to allow setscrews to extend therethrough and engage the upper portion of the index plate 24. In one form, the setscrews, schematically indicated at 56, can engage the upper portion 54, whereby rotationally locking the buffer tube 28 in place.

The dead blow buffer 26 is configured to receive an impact from a buffer 108 that is attached to a spring 106, which is configured to fit within the inner chamber 60 of the buffer tube assembly 20 (see FIG. 4). In general, the buffer is a weighted item that receives energy from a bolt and carriage assembly that is positioned in an upper receiver of an AR 15/M-16 or one of the variants. These common components are to be utilized with the buffer tube assembly, whereby the buffer is configured to reposition longitudinally rearwardly, where a longitudinal rearward portion will engage the dead blow buffer 26. In general, the dead blow buffer 26 can be made from a malleable material, in one form a soft rubber material having a durometer reading approximately at 45 (±25%). This allows absorbing energy from the buffer which can reduce the rate of fire approximately 120 rounds per minute. For example, malfunctions can occur when the rate of fire of a full auto M-16 is above 1,200 rounds per minute. Generally, when the fire rate is at 1,250 rounds per minute, for example, there is a high probability of malfunction where the rapid rate of the bolt and carriage assembly exceeds the rate a spring can reposition a round vertically for the bolt to engage around and feed it into the chamber. Therefore, reducing the firing rate is advantageous, in particular with shorter barreled guns. Present analysis has indicated that the rate of fire can be reduced by approximately 120 rounds per minute to achieve a rifle that will fire at 1,070 rounds per minute from 1,190 rounds per minute.

Figure 3:
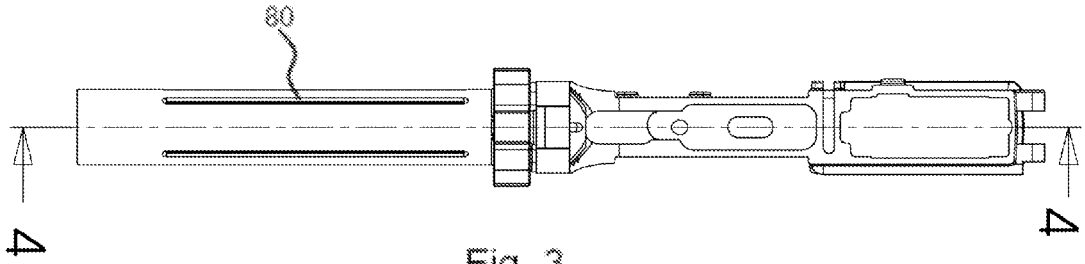
FIG. 3 shows a top-view of a buffer tube.

Referring now to FIG. 3, there can be seen surfaces defining longitudinally extending recesses 80. In general, these recesses can allow for grit and particulate matter to pass therethrough to allow a butt stock to slide there-along. As shown in FIG. 4, the positioning slots 82 are provided to engage a spring-driven engagement member that allows a butt stock to be selectively positioned along the buffer tube 28. It should also be noted in FIG. 4 that in one form the buffer tube 28 is a monolithic structure where the rifle engagement portion 86 is monolithic and rigidly attached to the stem portion 88. Further, the above-mentioned threaded extension 42, in one form, can be monolithic with the portions 86 and 88. It should further be noted that an extension member, such as a setscrew 90, can be provided to engage a detent with the indexing plate 24. Therefore, in this form the entire buffer tube 28 can be rotated to threadedly engage the lower receiver, as shown in FIG. 4, and thereafter the setscrews 56, shown in FIG. 5, can enter the longitudinally rearward portion of the surfaces defining openings 50 and extend therethrough to engage the upper portion 54 of the index plate 24. Thereafter, as shown in FIG. 4, the setscrew 90 can pass through the surface defining the opening in the rifle engagement portion 86 to positively engage the indexing plate at a position which is longitudinally rearward of the extension 46.

Figure 6:
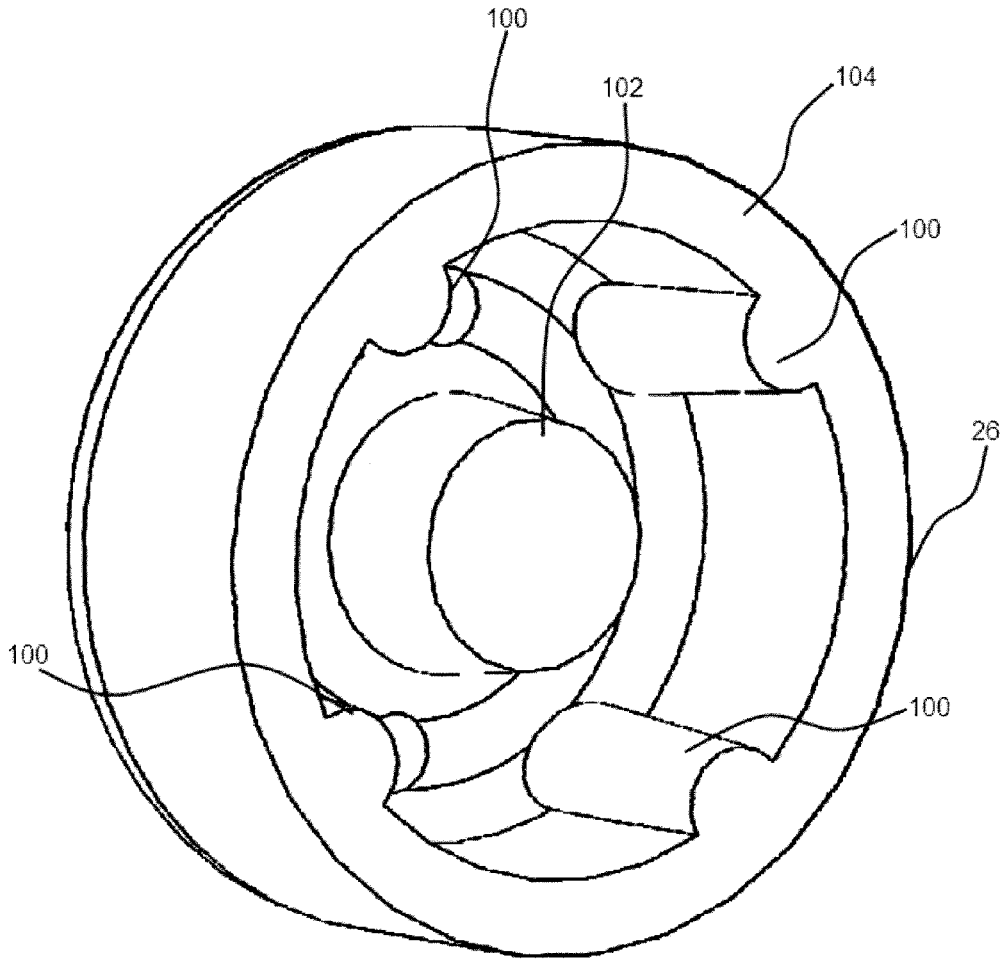
FIG. 6 shows the rear side of one embodiment of a dead blow buffer.
Figure 7:
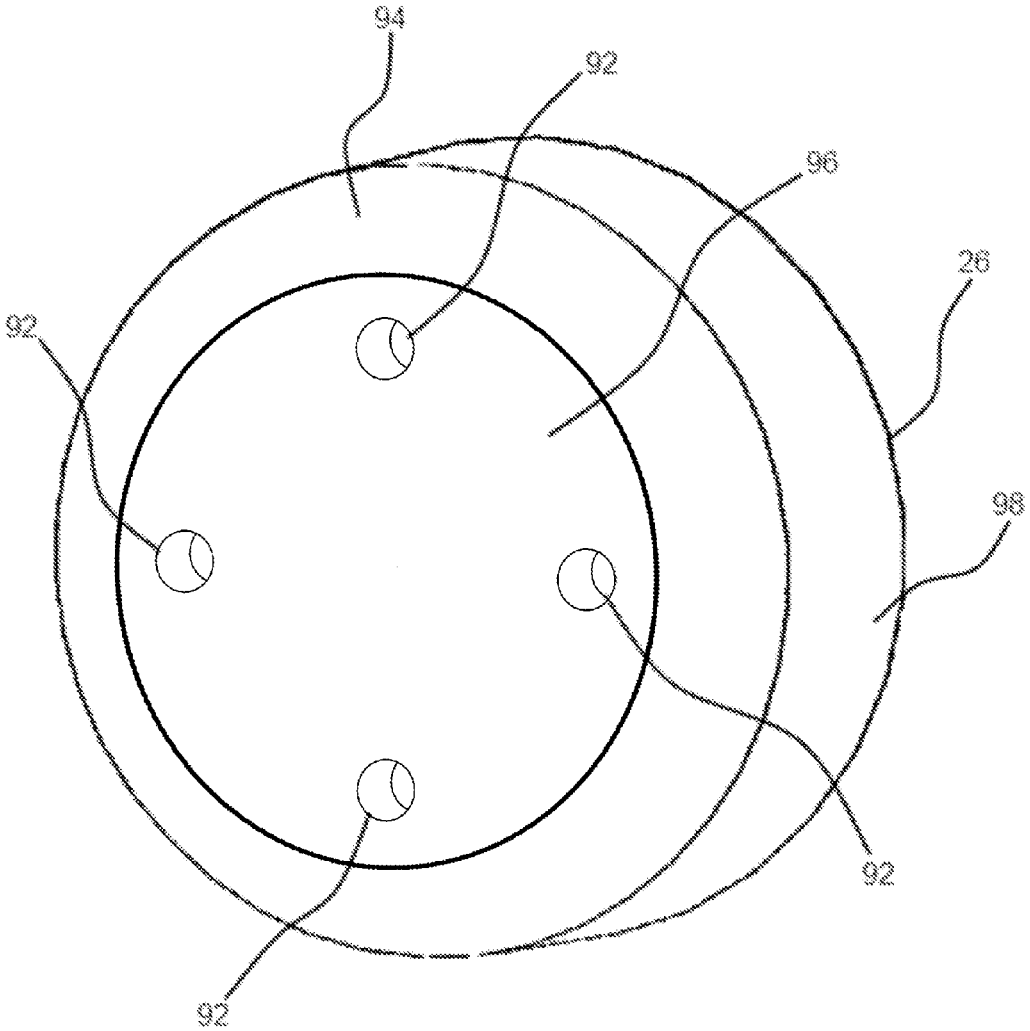
FIG. 7 shows the front side of one embodiment of a dead blow buffer.

Looking to FIGS. 6 and 7, one embodiment of a dead blow buffer 26 is shown having a rearwardly open interior void, which increases the malleability of the overall structure. A plurality of vent openings 92 may be provided to vent air therethrough when the dead blow buffer compresses. The front surface may comprise a rounded edge 94 from the front surface 96 to a side surface 98. In one form, as shown in FIG. 6, a plurality of structural supports 100 may be provided as well as a central support 102, which may not extend to a plane defined by the rearward edge 104. In one form, this embodiment is also a monolithic structure.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An improved buffer tube assembly comprising:

a. a buffer tube having a longitudinal forward end, a longitudinal rearward end, and an inner annular surface;

b. the buffer tube further comprising an attachment location at the longitudinal forward end thereof operably configured to couple the buffer tube to a lower receiver of a firearm such that the buffer tube is open at the forward end to the lower receiver;

c. wherein the inner annual surface of the buffer tube forms a passageway which extends into both the lower receiver and the buffer tube;

d. a dead blow buffer positioned at the longitudinally rearward portion of the buffer tube;

e. the dead blow buffer comprising an external surface configured to fit within and substantially in contact with the internal bore surface of the buffer tube;

f. wherein the dead blow buffer is configured to receive an impact from a weighted buffer that is attached to a buffer spring fitted within the buffer tube, and;

g. wherein the dead blow buffer is positioned between the rearmost portion of the inner annular surface of the buffer tube and the buffer spring.

2. The buffer tube assembly as recited in claim 1 wherein the firearm is selected from the list consisting of AR 15, AR 10, SR 25, or M-16.

3. The buffer tube assembly as recited in claim 1 further comprising:

a. an indexing plate configured to be positioned between the buffer tube and the lower receiver; and b. an indexing system in contact with each of the indexing plate and the buffer tube assembly to selectively adjust a gap therebetween.

4. The buffer tube assembly as recited in claim 3 wherein the indexing system comprises at least one set screw.

5. The buffer tube assembly as recited in claim 1 wherein the dead blow buffer is comprised of a malleable material having a durometer hardness between 34 to 56.

6. The buffer tube assembly as recited in claim 1 wherein the dead blow buffer is comprised of rubber.

7. The buffer tube assembly as recited in claim 1 wherein the buffer tube comprises surfaces defining voids therethrough to allow dirt and equivalent particles to pass therethough.

8. The buffer tube assembly as recited in claim 1 wherein the buffer tube is a monolithic structure.

9. The buffer tube assembly as recited in claim 1 wherein the dead blow buffer is a monolithic structure.

10. An improved buffer tube assembly comprising:

a. a buffer tube having a longitudinal forward end, a longitudinal rearward end, and an inner annular surface;

b. the buffer tube further comprising an attachment location operably configured to couple the buffer tube to a lower receiver of a firearm;

c. a dead blow buffer positioned at the longitudinally rearward portion of the buffer tube;

d. the dead blow buffer comprising an external surface configured to fit within and substantially in contact with the internal bore surface of the buffer tube;

e. wherein the dead blow buffer is configured to receive an impact from a weighted buffer that is attached to a buffer spring fitted within the buffer tube, f. wherein the dead blow buffer is positioned between the rearmost portion of the inner annular surface of the buffer tube and the buffer spring; and g. wherein the dead blow buffer comprises an interior void, and air vents to allow air to pass therethrough as the dead blow buffer compresses and reduces the airspace in the interior void.

11. An improved dead blow buffer for placement in the rearward portion of a buffer tube of a firearm, the dead blow buffer comprising:

a. a cylindrical external surface configured to fit within and substantially in contact with the internal bore surface of the buffer tube;

b. a front surface configured to receive an impact from a weighted buffer that is in contact with a buffer spring fitted within the buffer tube;

c. a rearwardly open interior void;

d. a plurality of vent openings through the front surface;

e. a central support extending rearward from the front surface; and f. wherein the dead blow buffer is comprised of a malleable material.

12. The dead blow buffer as recited in claim 11 further comprising a plurality of structural supports extending from an inner radial surface toward the central support.

* * * * *